United States Patent [19]

Hannen et al.

[11] Patent Number: 5,042,235

[45] Date of Patent: Aug. 27, 1991

[54] SYSTEM FOR SHRINK-WRAPPING PALLETIZED GOODS

[75] Inventors: Reiner W. Hannen, Goch-Pfalzdorf; Norbert Vermeulen, Kleve-Warbeyen, both of Fed. Rep. of Germany

[73] Assignee: MSK-Verpackungs-Systeme Gesellschaft mit beschrankter Haftung, Kleve, Fed. Rep. of Germany

[21] Appl. No.: 454,774

[22] Filed: Dec. 21, 1989

[30] Foreign Application Priority Data

Dec. 24, 1988 [DE] Fed. Rep. of Germany ... 8816085[U]

[51] Int. Cl.[5] ..... B65B 53/06

[52] U.S. Cl. ..... 53/557; 53/442

[58] Field of Search ..... 53/442, 459, 557, 567

[56] References Cited

U.S. PATENT DOCUMENTS

| | | | |
|---|---|---|---|
| 3,508,375 | 4/1970 | Myers | 53/442 X |
| 3,522,688 | 8/1970 | Kaliwoda et al. | 53/442 |
| 3,581,458 | 6/1971 | Gustavsson | 53/442 |
| 3,621,588 | 11/1971 | Grocke | 53/442 X |
| 3,667,598 | 6/1972 | Zelnick et al. | 53/442 X |
| 4,575,989 | 3/1986 | Hannen | 53/442 X |
| 4,724,658 | 2/1988 | Birkenfeld et al. | 53/442 X |

FOREIGN PATENT DOCUMENTS

| | | | |
|---|---|---|---|
| 0249534 | 12/1987 | European Pat. Off. | 53/442 |
| 0205135 | 1/1989 | European Pat. Off. . | |

*Primary Examiner*—Robert L. Spruill
*Assistant Examiner*—Daniel B. Moon
*Attorney, Agent, or Firm*—Herbert Dubno; Andrew Wilford

[57] ABSTRACT

Goods are packaged by first placing a thermoplastic lower foil atop a pallet with edges of the foil projecting laterally past the pallet and then stacking goods on the pallet atop the foil on the pallet within the edges of the foil. The lower edge of a downwardly open heat-shrinkable foil hood is held as the hood is fitted downward over the stack on the pallet until the lower edge is generally below the stack. This lower edge is then gripped below the stack and the foil hood is shrunk from top to bottom around the stack while continuing to grip the lower edge below the stack. Finally the foil hood is welded to the outer edge of the lower foil. Thus when the grippers are carried on the same vertically displaceable frame as the heater/blowers it is possible for the grippers to release and move upward before the top-to-bottom shrinking of the hood. During such shrinking the clamps will prevent the hood or sack from riding up too much.

8 Claims, 3 Drawing Sheets

SYSTEM FOR SHRINK-WRAPPING PALLETIZED GOODS

FIELD OF THE INVENTION

The present invention relates to the packaging of goods on a pallet. More particularly this invention concerns a method of and apparatus for shrink-wrapping palletized goods.

BACKGROUND OF THE INVENTION

It is known to transport and store stacks of goods, for instance bottles or cases of canned foodstuffs, on pallets and to protect and stabilize the palletized stack with a shrink wrap. To this end a lower shrinkable foil is laid atop the pallet, the stack is formed atop this lower foil, an upper foil hood is pulled down over the stack, and the foils are shrunk around the goods.

In a standard prior-art system the hood is gripped at its edge and pulled down over the stack by grippers carried on an annular frame that is vertically displaceable at the wrapping station. Once the hood is in place its edge is released and heater/blowers on the frame are activated as the frame is raised to shrink the wrap and in fact to weld it to the outer edge of the lower foil on which the stack sits, thereby also securing the palletized stack to the pallet. Such an arrangement can trap air in the package and form bubbles as the air is heated. These bubbles do not always recede completely when the package subsequently cools. In addition diagonal folds frequently form at the corners of the package so that the resin of the shrink wrap is insufficiently heated where it is doubled over. What is more the pockets formed by such folds can trap water when the palletized package is stored outside, creating the possibility of leakage and subsequent handling problems. Furthermore as the foil shrinks there is excessive shrinking adjacent the poorly heated doubled areas so that holes can appear at these excessively shrunk regions.

European patent application 205,135 describes a system which avoids some of these problems by holding the bottom edge of the hood out away from the package and by applying the heat from top to bottom while air is aspirated from beneath the package, an effect achieved by releasing the bottom edge of the upper hood foil, raising the frame to its uppermost position, and then activating the heater/blowers as the frame is once again lowered. This system does indeed avoid the formation of bubbles. Nonetheless the upper hood foil frequently shrinks such that it pulls up away from the pallet so that by the time the heater/blowers are in their lowermost position the lower edge of the upper foil is spaced above the lower foil and can no longer be welded to it.

OBJECTS OF THE INVENTION

It is therefore an object of the present invention to provide an improved method of and apparatus for shrinking a stack of goods on a pallet.

Another object is the provision of such an improved method of and apparatus for shrinking a stack of goods on a pallet which overcomes the above-given disadvantages, that is which completely avoids the formation of bubbles in the wrap while still ensuring complete encasing of the stack being packaged.

SUMMARY OF THE INVENTION

According to this invention goods are packaged by first placing a thermoplastic lower foil atop a pallet with edges of the foil projecting laterally past the pallet and then stacking goods on the pallet atop the foil on the pallet within the edges of the foil. The lower edge of a downwardly open heat-shrinkable foil hood is held as the hood is fitted downward over the stack on the pallet until the lower edge is generally below the stack. This lower edge is then gripped below the stack and the foil hood is shrunk from top to bottom around the stack while continuing to grip the lower edge below the stack. Finally the foil hood is welded to the outer edge of the lower foil.

Thus when, according to a further feature of this invention the grippers are carried on the same vertically displaceable frame as the heater/blowers it is possible for the grippers to release and move upward before the top-to-bottom shrinking of the hood. During such shrinking the clamps will prevent the hood or sack from riding up too much.

In accordance with this invention the lower edge is gripped by being pinched against abutments below the pallet. Normally the abutments are constituted as stationary longitudinally extending rails that flank the packaging station. The pallet itself normally has transversely extending leading and trailing beams having leading and trailing faces constituting the abutments against which the respective portions of the lower edge are clamped.

The lower edge of the foil hood is welded according to this invention to the outer edge of the lower foil below the stack in a skirt that is shrunk-fit around the pallet. This makes for a very solid package which, when opened, will allow the goods to be readily separated from the pallet.

The abutments and the clamps according to this invention lie below a plane defined by an upper surface of the pallet. These clamps are constituted as L-shaped clamp arms pivoted about horizontal axes parallel to the respective sides of the normally parallepipedal stack and pallet.

In order to further prevent bubbles from forming in the package a blower is provided having an intake open upward underneath the support surface and downwardly opening output for aspirating air from underneath the hood.

DESCRIPTION OF THE DRAWING

The above and other objects, features, and advantages will become more readily apparent from the following, reference being made to the accompanying drawing in which.

SPECIFIC DESCRIPTION

Figure 1:
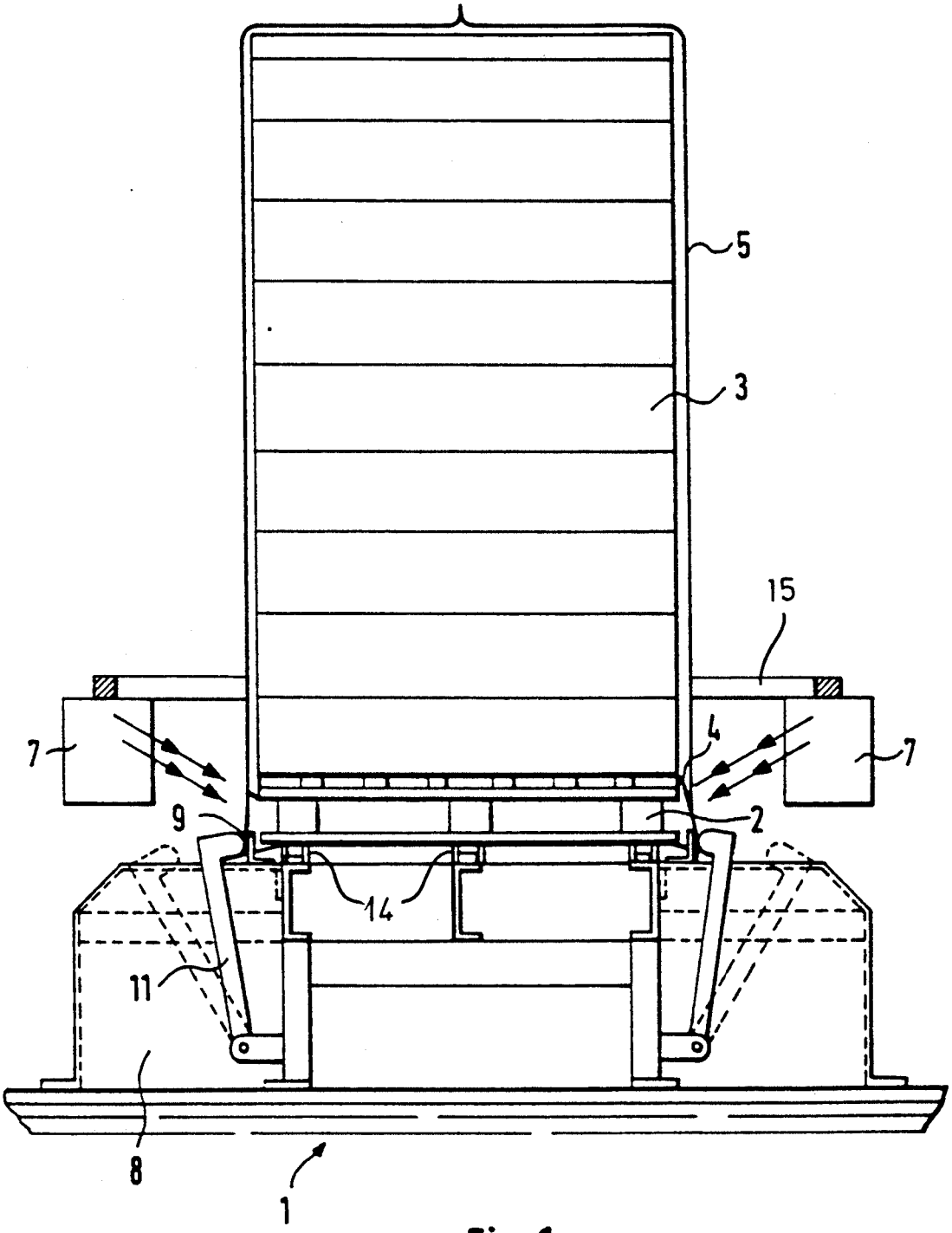
FIG. 1 is an end view of the stacking system of this invention.
Figure 2:
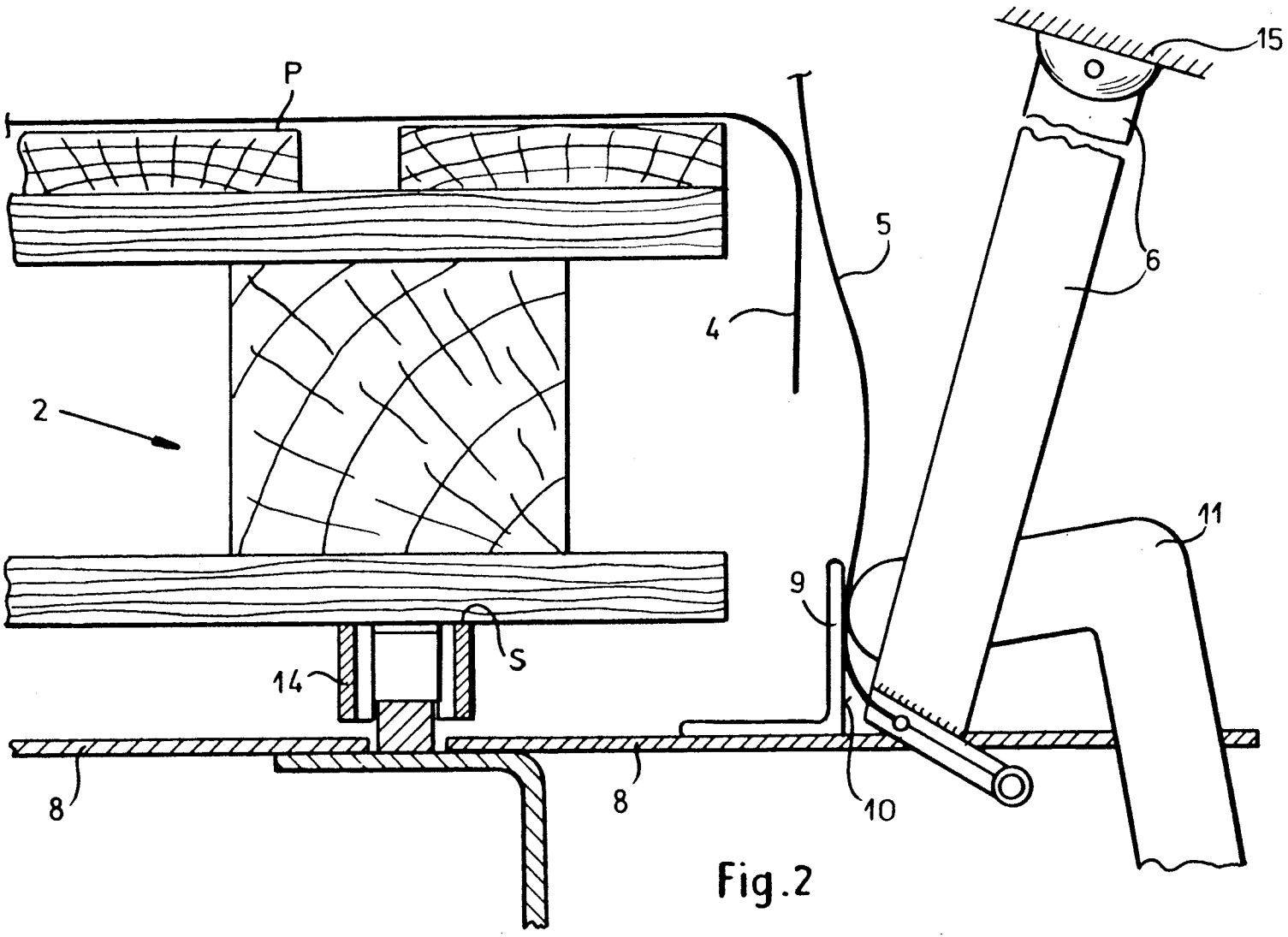
FIG. 2 is a large-scale view of a detail of FIG. 1.
Figure 3:
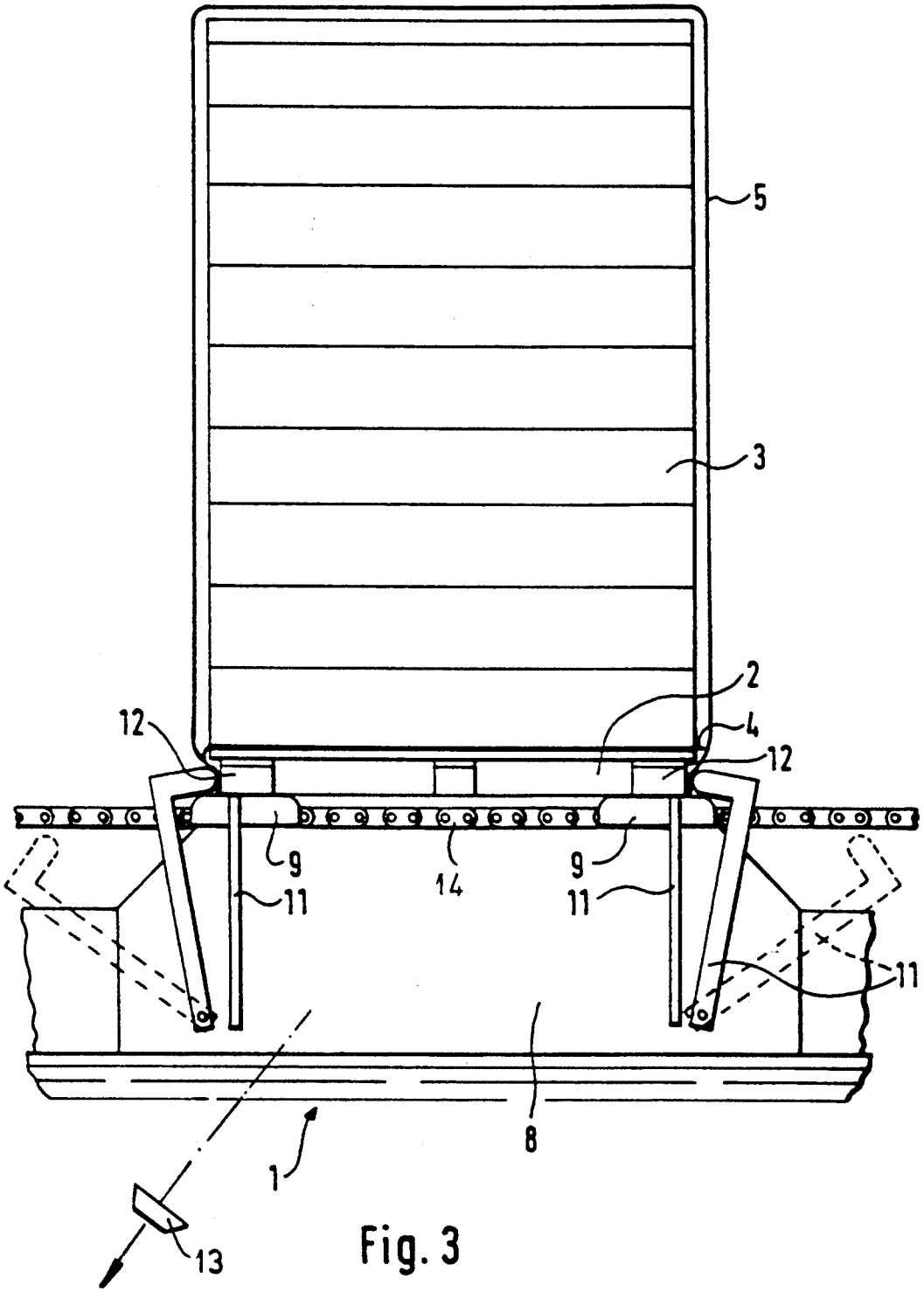
FIG. 3 is a side view of the stacking system.

As seen in FIGS. 1 through 3 a packaging station 1 holds a pallet 2 carrying a stack 3 of goods to be packaged. A thermoplastic foil 4 lies atop the pallet 2 underneath the stack 3 and has its outer edge projecting out from beneath the stack 3 and, to start with, hanging down like a skirt around the pallet 2.

For hygienic shrink wrapping a thermoplastic and shrinkable synthetic-resin sack or hood 5 is fitted down over the stack 3. This is done by grasping its lower edge with a plurality of grippers 6 carried by unillustrated connections on a vertically displaceable frame 15 and engaging this lower edge at a plurality of location spaced around the stack 3. The hood 5 is pulled down over the stack 3 until its lower edge hangs all the way down past the pallet and, in fact, past a support surface S formed by conveyor chains 14 supporting the pallet 2.

According to this invention the support surface S is transversely flanked by longitudinally extending angle-iron abutments 9 that lie wholly below the stack 3 and also below the entire foil 4 and that define longitudinally extending and vertical surfaces 10 against which L-shaped pivotal clamp arms 11 can press the lower edge of the hood 5. Similar such arms projecting up between the chains 14 can press the transversely extending leading and trailing portions of the lower edge of the hood against abutments formed by the transversely extending beams 12 of the pallet. The clamps 11 are offset from the grippers 6 so that the lower edge of the hood 5 can be clamped against the abutments 10 and 12 before it is released by these grippers 6.

The frame 15 also carries standard blower/heater units 7 and an exhaust fan 13 has a downwardly open output and an intake connected to a box 8 formed underneath the surface S and provided with intake slots under this surface S for drawing off air driven out of the hood 5.

Thus with this arrangement the hood 5 is fitted dow around the stack 3 and its lower edge is clamped in place. The grippers 6 are then released and the frame 15 moves to a position at the top of the stack 3 whereupon the heater/blowers 7 are activated and this frame 15 is lowered. Thus the sack-like hood 5 is shrunk tightly around the stack and, when the heater/blowers 7 come level with the lower end of the stack, the hood 5 is welded to the outer edge of the foil 4 and in fact shrinks up around the pallet to secure the stack 3 tightly in place thereon. Meanwhile air inside the hood 5 is sucked out by the blower 13 to ensure that no bubbles are formed. When the frame 15 has reached its lowermost position the clamps 11 are released and the conveyor chains 14 are advanced to move the shrink-wrapped palletized stack 3 off longitudinally, that is left-to-right as seen in FIG. 3.

What is claimed is:

1. An apparatus for packaging a stack of goods sitting on a pallet and on a thermoplastic lower foil with an outer edge projecting past the stack, the apparatus comprising:

a support defining a surface carrying the pallet, lower foil, and stack;

means including grippers for holding a lower edge of a downwardly open heat-shrinkable foil hood and fitting the hood downward over the stack on the pallet until the lower edge is generally below the stack;

means including at least two longitudinally extending and transversely spaced rails flanking the surface and clamps below the stacks for securing the lower edge below the stack adjacent the grippers; and means including a vertically displaceable heater unit for shrinking the foil hood from top to bottom around the stack while continuing to grip the lower edge below the stack and for welding the foil hood to the outer edge of the lower foil.

2. The packaging apparatus defined in claim 1 wherein the rails are below a plane defined by an upper surface of the pallet.

3. The packaging apparatus defined in claim 2 wherein the pallet has leading and trailing members defining transversely extending and longitudinally spaced abutments bridging the rails.

4. The packaging apparatus defined in claim 1 wherein the clamps are pivotal clamp arms.

5. The packaging apparatus defined in claim 1 wherein the clamps are below a plane defined by an upper surface of t he pallet.

6. The packaging apparatus defined in claim 1 wherein the clamps are arms pivotal about horizontal axes.

7. The packaging apparatus defined in claim 1, further comprising blower means having an intake open upward underneath the support surface and a downwardly opening output for aspirating air from underneath the hood.

8. An apparatus for packaging a stack of goods sitting on a pallet and on a thermoplastic lower foil with an outer edge projecting past the stack, the apparatus comprising:

a support defining a surface carrying the pallet, lower foil, and stack;

a frame vertically displaceable adjacent the pallet;

means including grippers mounted on the frame for holding a lower edge of a downwardly open heat-shrinkable foil hood and fitting the hood downward over the stack on the pallet until the lower edge is generally below the stack;

means including at least two longitudinally extending and transversely spaced rails flanking the surface and clamps below the stacks for gripping the lower edge blow the stack; and means including a vertically displaceable heater unit mounted on the frame for shrinking the foil hood from top to bottom around the stack while continuing to grip the lower edge below the stack and for welding the foil hood to the outer edge of the lower foil.

* * * * *